United States Patent [19]

Doi et al.

[11] 4,309,585

[45] Jan. 5, 1982

[54] ERROR ALARM SYSTEM IN A MICROWAVE OVEN

[75] Inventors: Keiichiro Doi, Izumi; Toshihiro Kashiwagi, Osaka, both of Japan

[73] Assignee: Sharp Kabushiki Kaisha, Osaka, Japan

[21] Appl. No.: 104,783

[22] Filed: Dec. 18, 1979

[30] Foreign Application Priority Data

Dec. 19, 1978 [JP] Japan ..... 53/165462
Dec. 19, 1978 [JP] Japan ..... 53/165463

[51] Int. Cl.[3] ..... H05B 6/66

[52] U.S. Cl. ..... 219/10.55 B; 219/10.55 C; 219/506; 99/342; 49/13; 340/687

[58] Field of Search ..... 219/10.55 R, 10.55 B, 219/10.55 C, 10.55 E, 506, 516, 518; 73/352; 99/421 TP, 342; 49/13; 340/687

[56] References Cited

U.S. PATENT DOCUMENTS

| | | | |
|---|---|---|---|
| 3,330,203 | 7/1967 | Korr | 219/518 X |
| 3,590,605 | 7/1971 | Low | 340/687 X |
| 3,842,724 | 10/1974 | Korr et al. | 219/518 X |
| 4,035,787 | 7/1977 | Hornung | 219/10.55 B X |
| 4,117,294 | 9/1978 | Appelquist et al. | 219/10.55 C |
| 4,122,322 | 10/1978 | Ohkubo et al. | 219/10.55 E X |

OTHER PUBLICATIONS

*TMX 1117IL 4-Bit Microcomputer Preprogrammed Microwave Oven Controller Manual* by Texas Instruments, 1976.

*Primary Examiner*—Gene Z. Rubinson
*Assistant Examiner*—Keith E. George
*Attorney, Agent, or Firm*—Birch, Stewart, Kolasch and Birch

[57] ABSTRACT

A microwave oven comprises a digital control circuit for controlling microwave generation, and a multi-digit digital display unit for displaying a cooking condition. A determination system is associated with a door switch for developing a display control signal when a cook start switch is actuated before an oven door is tightly closed. In response to the display control signal, an alarm display, for example, "DOOR" is provided on the multi-digit digital display unit. The microwave oven further comprises a food temperature sensor probe for sensing a temperature of foodstuff being cooked. The multi-digit digital display unit provides another alarm display, for example, "PROBE" if the cook start switch is actuated under the condition where the food temperature sensor probe is not placed in its operative condition even though the food temperature control mode of operation is selected.

6 Claims, 6 Drawing Figures

ERROR ALARM SYSTEM IN A MICROWAVE OVEN

BACKGROUND AND SUMMARY OF THE INVENTION

The present invention relates to a microwave oven and, more particularly, to an alarm system for warning of an error condition in a microwave oven.

In a microwave oven it is strictly required that the oven door be tightly closed before initiation of the microwave generation. A door latch mechanism and a door switch system are well developed in the microwave oven field, wherein the microwave generation is prevented unless the oven door is tightly closed. However, there is a possibility that a cook start switch might be actuated before the oven door is tightly closed. One feature of the present invention relates to an alarm display for warning of an error condition when the cook start switch is actuated under the condition where the oven door is not tightly closed.

On the other hand, recently, a microwave oven has been developed, which has a control system responding to an output signal derived from a sensor probe for detecting a temperature of foodstuff being cooked. In such a system, there is a possibility that an operator will erroneously instruct a temperature control mode of operation without placing the sensor probe in its operative condition. Another feature of the present invention relates to an alarm display for warning of an error condition when the cook start switch is actuated without placing the sensor probe in its operative condition in the temperature control mode of operation.

Accordingly, an object of the present invention is to provide an alarm display system for warning of an error condition in a microwave oven.

Another object of the present invention is to provide an alarm display system for warning of an error condition when a cook start switch is erroneously actuated before an oven door is tightly closed.

Still another object of the present invention is to provide an alarm display system for warning of an error condition when a cook start switch is erroneously actuated without placing a temperature sensor probe in its operative condition in a cooking temperature control mode of operation.

Yet, another object of the present invention is to provide a digital display system for performing an alarm display in a microwave oven.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, an alpha-numeric digital display unit is provided for displaying a cooking time period in a cooking time period control mode and for displaying a food temperature in a cooking temperature control mode.

A microwave oven is provided with a first detection system for developing a first detection output when a cook start switch is erroneously actuated before an oven door is tightly closed.

A display driver is associated with the first detection system for conducting an alarm display, for example, "DOOR" on the alpha-numeric digital display unit in response to the first detection output.

The microwave oven is further provided with a second detection system for developing a second detection output when a cook start switch is erroneously actuated under the condition where a temperature sensor probe is not placed in its operative condition in the cooking temperature control mode. The display driver is associated with the second detection system for conducting an alarm display, for example, "PROBE" on the alpha-numeric digital display unit in response to the second detection output.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
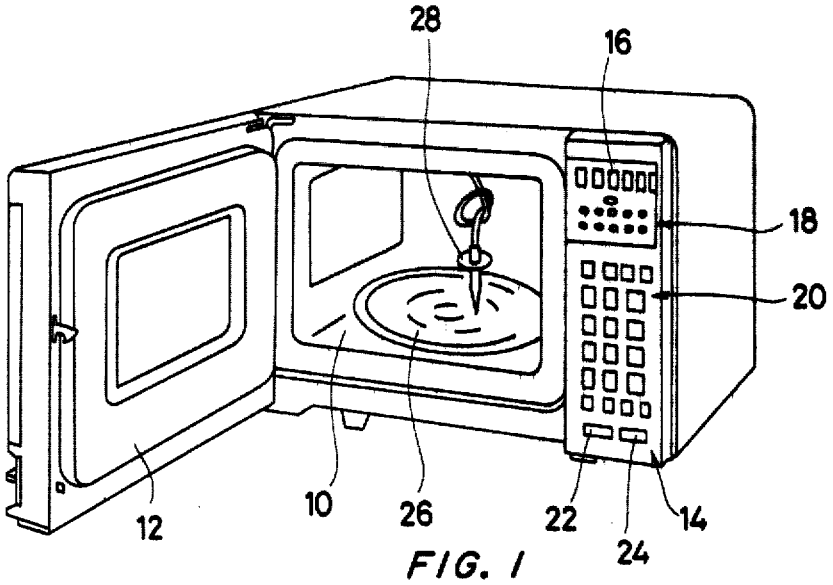
FIG. 1 is a perspective view of a microwave oven employing an embodiment of an error alarm system of the present invention.

FIG. 1 shows a microwave oven employing an embodiment of an error alarm system of the present invention.

The microwave oven mainly comprises an oven cavity 10, an oven door 12, and a control panel 14. The control panel 14 includes a digital display unit 16 such as a multi-digit alpha-numeric display unit, a mode display unit 18, and a key input unit 20.

Figure 2:
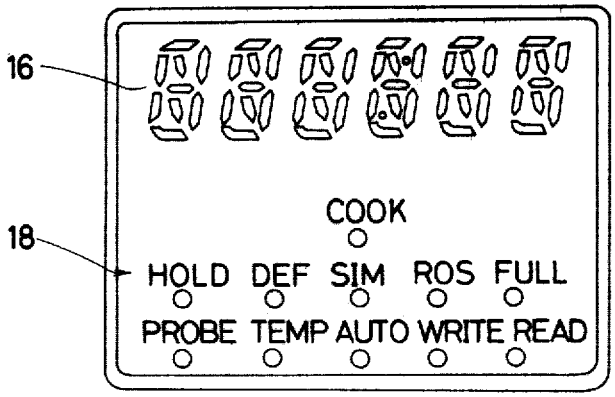
FIG. 2 is a plan view of a digital display panel included in the microwave oven of FIG. 1.

FIG. 2 shows, in detail, the digital display unit 16 and the mode display unit 18.

The digital display unit 16 comprises a six-digit alpha-numeric display unit for displaying a cook time period in a time period control mode, and for displaying a set temperature in a temperature control mode. The digital display unit 16 can be made of a multi-digit matrix display panel. The mode display unit 18 comprises eleven light emitting diodes for indicating the following modes of operation.

COOK: cooking operation is conducted
HOLD: pause
DEF: defrost mode
SIM: simmer mode
ROS: roast mode
FULL: full power mode
PROBE: food temperature control mode
TEMP: cooking temperature control mode
AUTO: timer controlled auto start
WRITE: program write-in mode
READ: program read-out mode The key input unit 20 comprises a plurality of mode selection switches for selecting a desired mode of operation, numeral keys for introducing a desired cooking time period or a desired set temperature, a cook start switch 22 and a reset switch 24.

The microwave oven of FIG. 1 includes a digital control circuit responding to instruction commands introduced through the mode selection switches and numeral information introduced through the numeral keys. A typical construction of the digital controlled microwave oven is described in U.S. Pat. No. 4,011,428, "MICROWAVE OVEN TIMER AND CONTROL CIRCUIT" by Fosnough et al, issued on Mar. 8, 1977.

The microwave oven of FIG. 1 further comprises a turntable 26 disposed in the oven cavity 10, and a temperature sensor probe 28 for detecting a temperature of foodstuff being cooked in the oven cavity 10. The temperature sensor probe 28 is removably secured to a socket provided in the upper wall of the oven cavity 10. A typical construction of the temperature sensor probe 28 and the socket is described in U.S. Pat. No. 4,149,056, "MICROWAVE OVEN WITH FOOD TEMPERATURE-SENSING MEANS" by Kaneshiro et al, issued on Apr. 10, 1979.

Figure 3:
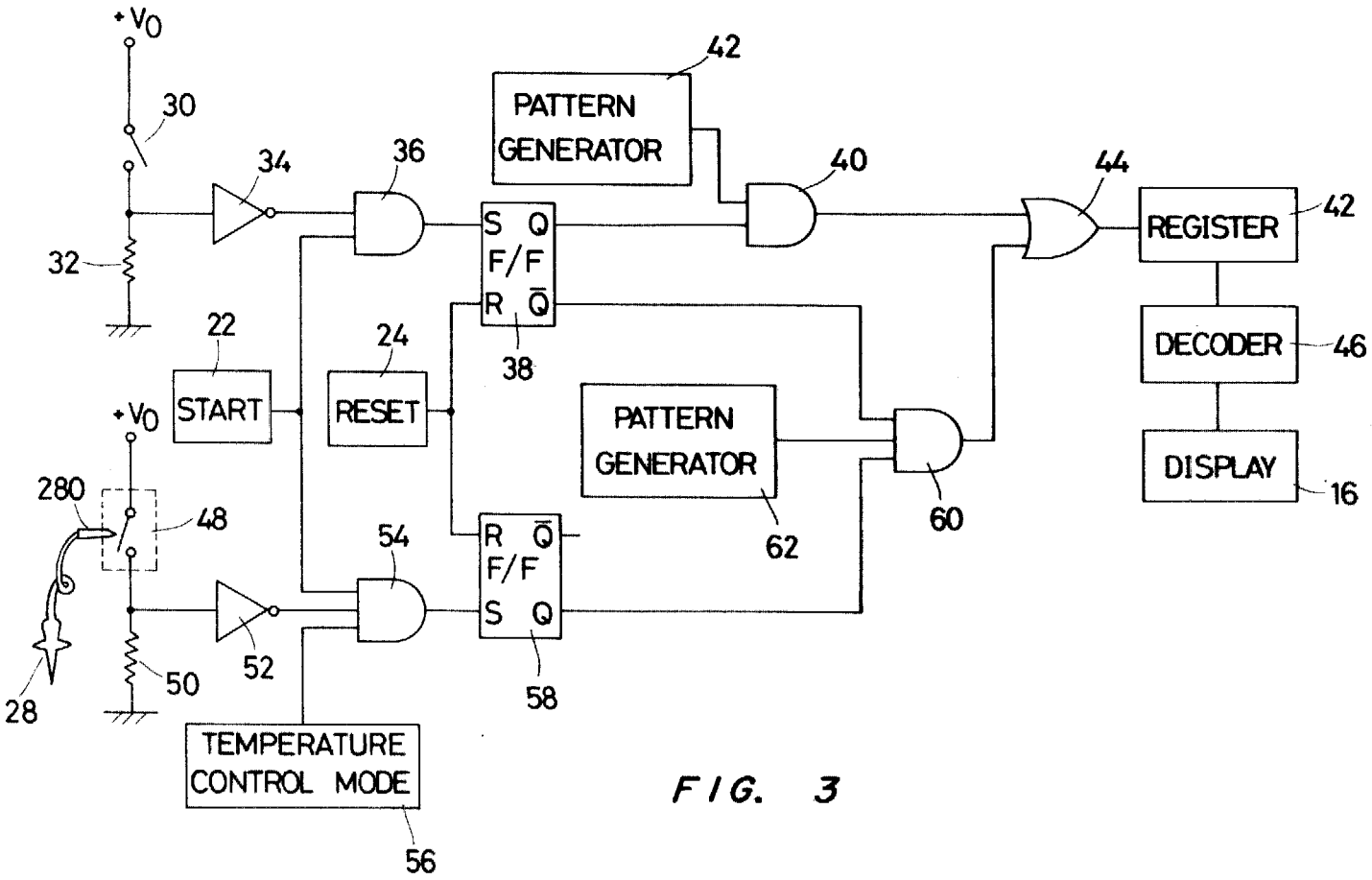
FIG. 3 is a block diagram of an embodiment of an alarm display control circuit of the present invention.

FIG. 3 shows an embodiment of an alarm display control circuit of the present invention. Like elements corresponding to those of FIG. 1 are indicated by like numerals.

The alarm display control circuit comprises a conventional door switch 30 which is closed when the oven door 12 is tightly closed. One terminal of the door switch 30 is connected to receive a power supply $+V_0$, and the other terminal of the door switch 30 is connected to a resistor 32. The other terminal of the door switch 30 is also connected to an inverter 34. Accordingly, when the oven door 12 is open and, hence, the door switch 30 is open, the input signal to the inverter 34 bears the low level (logic "0") and the output signal of the inverter 34 bears the high level (logic "1"). Contrarily, when the oven door 12 is tightly closed and, hence, the door switch 30 is closed, the input signal to the inverter 34 bears the high level (logic "1") and the output signal of the inverter 34 bears the low level (logic "0").

The output signal of the inverter 34 is applied to one input terminal of an AND gate 36, the other input terminal of the AND gate 36 being connected to receive an output signal derived from the cook start switch 22. An output signal of the AND gate 36 is applied to a set input terminal of an R-S flip-flop 38. Accordingly, when the cook start switch 22 is actuated before the oven door 12 is tightly closed, the flip-flop 38 is set. The set output signal of the flip-flop 38 is applied to an AND gate 40 to make it conductive.

Figure 4:
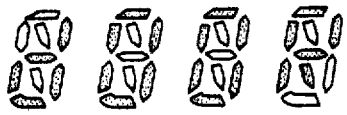
FIGS. 4, 5 and 6 are plan views of examples of alarm display achieved by the digital display panel of FIG. 2.
Figure 5:
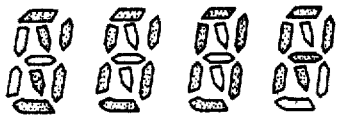

The other input terminal of the AND gate 40 is connected to receive a signal derived from a first pattern generator 42. The first pattern generator 42 stores a code signal for achieving an alarm display, for example, "dOOR" and "DOOR". The code signal derived from the AND gate 40 is applied to a register 42 through an OR gate 44. In this way, the alarm display is conducted on the digital display unit 16 through a decoder 46 when the cook start switch 22 is actuated before the oven door 12 is tightly closed. FIGS. 4 and 5 show the alarm display conditions conducted by the digital display unit 16.

The alarm display "dOOR" or "DOOR" disappears when the reset switch 24 is actuated. The operator must tightly close the oven door 12 and again actuate the cook start switch 22.

The alarm display control circuit further comprises a detection switch 48 which is closed when a plug 280 of the temperature sensor probe 28 is inserted into the socket provided in the upper wall of the oven cavity 10. One terminal of the detection switch 48 is connected to receive the power supply $V_0$, and the other terminal of the detection switch 48 is connected to a resistor 50. The other terminal of the detection switch 48 is also connected to an inverter 52. Accordingly, when the temperature sensor probe 28 is not placed in its operative condition and, hence, the detection switch 48 is open, the input signal to the inverter 52 bears the low level (logic "0") and the output signal of the inverter 52 bears the high level (logic "1"). If the plug 280 is inserted into the socket to close the detection switch 48, the input signal to the inverter 52 bears the high level (logic "1") and the output signal of the inverter 52 bears the low level (logic "0").

The output signal of the inverter 52 is applied to a first input terminal of an AND gate 54. A second input terminal of the AND gate 54 receives a high level signal (logic "1") when a food temperature control mode is selected by a food temperature control mode switch 56 included in the mode selection switches. A third input terminal of the AND gate 54 is connected to the cook start switch 22. An output signal of the AND gate 54 is applied to a set input terminal of an R-S flip-flop 58.

Accordingly, when the cook start switch 22 is actuated under the condition where the plug 280 is not inserted into the socket even though the food temperature control mode is selected, the AND gate 54 develops a signal to set the flip-flop 58. The set output signal of the flip-flop 58 is applied to an AND gate 60. The AND gate 60 also receives a signal derived from a second pattern generator 62. The second pattern generator 62 stores a code signal for achieving an alarm display, for example, "PRObE".

The AND gate 60 further receives a reset output of the R-S flip-flop 38 to assign the priority to the alarm display related to the "DOOR". More specifically, the AND gate 60 is not conductive when the cook start switch 22 is erroneously actuated before the oven door 12 is tightly closed without regard to the condition of the food temperature sensor probe 28.

Figure 6:
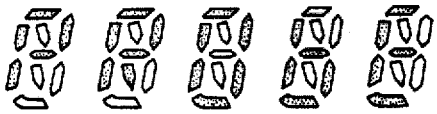

The code signal derived from the AND gate 60 is applied to the register 42 through the OR gate 44, thereby achieving an alarm display "PRObE" on the digital display unit 16. FIG. 6 shows the alarm display provided on the digital display unit 16.

The alarm display "PRObE" disappears when the reset switch 24 is actuated. The operator must put the food temperature sensor probe 28 in its operative condition and again actuate the cook start switch 22.

The invention being thus described, it will be obvious that the same may be varied in many ways. Such variations are not to be regarded as a departure from the spirit and scope of the invention, and all such modifications are intended to be included within the scope of the following claims.

What is claimed is:

1. In a microwave oven comprising an oven body, an oven door secured to the oven body, a multi-digit digital display unit, and a cook start switch for instructing initiation of microwave generation, the improvement comprising:

a first detection switch means for detecting whether said oven door is closed or open;

a first determination means associated with said first detection switch means and said cook start switch for developing a first control signal when said cook start switch is actuated under the condition where said oven door is open; and a first display driver for providing an alarm display on said multi-digit digital display unit in response to said first control signal.

2. The microwave oven of claim 1 further comprising first holding means for holding said first control signal.

3. The microwave oven of claim 1, wherein said multi-digit digital display unit comprises a multi-digit alpha-numeric digital display unit for displaying a set time period when the microwave oven is placed in a cooking time period control mode and for displaying a set temperature when the microwave oven is placed in a cooking temperature control mode.

4. The microwave oven of claim 1, 2 or 3, further comprising:

a food temperature sensor probe for detecting a temperature of foodstuff being cooked;

a second detection switch means for detecting whether said food temperature sensor probe is placed in its operative condition;

a second determination means associated with said second detection switch means and said cook start switch for developing a second control signal when said cook start switch is actuated under the condition where said food temperature sensor probe is not placed in said operative condition; and a second display driver for providing an alarm display on said multi-digit digital display unit in response to said second control signal.

5. The microwave oven of claim 4 further comprising second holding means for holding said second control signal.

6. The microwave oven of claim 5, wherein said second holding means comprises an R-S flip-flop of which the set input terminal is connected to receive said second control signal.

* * * * *